US010784559B2

(12) United States Patent
Zhou

(10) Patent No.: US 10,784,559 B2
(45) Date of Patent: Sep. 22, 2020

(54) RAIL-TYPE PORTABLE SATELLITE COMMUNICATION ANTENNA

(71) Applicant: E4E Information Technologies Co., Ltd., Guangzhou (CN)

(72) Inventor: Jingbin Zhou, Guangzhou (CN)

(73) Assignee: E4E INFORMATION TECHNOLOGIES CO., LTD. (CN)

( * ) Notice: Subject to any disclaimer, the term of this patent is extended or adjusted under 35 U.S.C. 154(b) by 52 days.

(21) Appl. No.: 16/325,784

(22) PCT Filed: Aug. 30, 2016

(86) PCT No.: PCT/CN2016/097323

§ 371 (c)(1),
(2) Date: Feb. 15, 2019

(87) PCT Pub. No.: WO2018/032534

PCT Pub. Date: Feb. 22, 2018

(65) Prior Publication Data

US 2019/0221912 A1 Jul. 18, 2019

(30) Foreign Application Priority Data

Aug. 19, 2016 (CN) ..... 2016 1 0693626

(51) Int. Cl.
*H01Q 1/08* (2006.01)
*H01Q 3/04* (2006.01)
(Continued)

(52) U.S. Cl.
CPC ..... *H01Q 1/084* (2013.01); *H01Q 1/08* (2013.01); *H01Q 1/1207* (2013.01);
(Continued)

(58) Field of Classification Search
CPC ..... H01Q 1/08; H01Q 1/084; H01Q 1/18; H01Q 1/185; H01Q 1/1207; H01Q 1/1235;
(Continued)

(56) References Cited

U.S. PATENT DOCUMENTS 5,019,833 A * 5/1991 Nonaka ..... H01Q 1/273 343/840
6,344,833 B1 * 2/2002 Lin ..... H01Q 1/40 343/785
(Continued)

FOREIGN PATENT DOCUMENTS

CN 2854837 Y 1/2007
CN 101950844 A 1/2011
(Continued)

OTHER PUBLICATIONS

International Search Report PCT/CN2016/097323, dated Mar. 2017.

*Primary Examiner* — Haissa Philogene
(74) *Attorney, Agent, or Firm* — Schmeiser, Olsen & Watts, LLP

(57) ABSTRACT

Provided is a rail-type portable satellite communication antenna including an antenna communication module, a supporting module, a rail base and a driving module for driving the supporting module to rotate horizontally and to regulate its pitch angle; the rail base, the supporting module and driving module are located at bottom of the antenna communication module, the driving modules are located at each corner of the supporting module, the supporting module is connected slidably to the rail base. The rail-type portable satellite communication antenna features light weight, compact size, easy to carry and manufacture.

14 Claims, 6 Drawing Sheets

(51) Int. Cl.

| | |
|---|---|
| ***H01Q 15/16*** | (2006.01) |
| ***H01Q 1/12*** | (2006.01) |
| ***H01Q 1/42*** | (2006.01) |
| ***H01Q 3/08*** | (2006.01) |
| ***H01Q 15/14*** | (2006.01) |
| ***H01Q 19/13*** | (2006.01) |

(52) U.S. Cl.
CPC ..... *H01Q 1/1235* (2013.01); *H01Q 1/42* (2013.01); *H01Q 3/04* (2013.01); *H01Q 3/08* (2013.01); *H01Q 15/14* (2013.01); *H01Q 15/16* (2013.01); *H01Q 19/132* (2013.01)

(58) Field of Classification Search
CPC ..... H01Q 1/125; H01Q 1/273; H01Q 1/288; H01Q 1/42; H01Q 1/3275; H01Q 3/04; H01Q 3/08; H01Q 15/14; H01Q 15/16; H01Q 19/132
See application file for complete search history.

(56) References Cited

U.S. PATENT DOCUMENTS

| | | | | |
|---|---|---|---|---|
| 7,382,327 | B2 | 6/2008 | Nelson | |
| 7,557,764 | B2 * | 7/2009 | Krajicek ..... | H01Q 1/1207 343/713 |
| 8,902,121 | B1 * | 12/2014 | Locker ..... | H01Q 1/1235 248/125.8 |
| 10,310,264 | B2 * | 6/2019 | Imasaka ..... | G02B 27/0101 |

FOREIGN PATENT DOCUMENTS

| | | | |
|---|---|---|---|
| CN | 106129581 | A | 11/2016 |
| CN | 205985297 | U | 2/2017 |
| CN | 205985306 | U | 2/2017 |

* cited by examiner

RAIL-TYPE PORTABLE SATELLITE COMMUNICATION ANTENNA

CROSS-REFERENCE TO RELATED APPLICATIONS

This application claims priority to PCT Application No. PCT/CN2016/097323, having a filing date of Aug. 30, 2016, based off Chinese application No. 201610693626.4 having a filing date of Aug. 19, 2016, the entire contents of both of which are hereby incorporated by reference.

FIELD OF TECHNOLOGY

The following relates to a field of satellite communication antennas, in particular to a rail-type portable satellite communication antenna.

BACKGROUND

VSAT is also called small terminal, small data station or Very Small Aperture Terminal, and can support various services. The terminal has a compact structure with a small sized antenna, and also features low energy consumption, low cost, and easy installation. However, due to factors of gravity, rotary inertia, and wind load, etc., such conventional portable satellite communication antenna requires high accuracy of rotary clearance of transmission mechanism and strict manufacturing process.

This is because, rotary clearance of transmission mechanism should be smaller than one eighth (⅛) of half-power beamwidth, e.g. an antenna with 1 meter diameter at Ku-band has a half-power beamwidth (3 dB beamwidth) of 1.6° at the receiving end and a half-power beamwidth (3 dB beamwidth) of 1.4° at the transmitting end, therefore rotary clearance of transmission mechanism should be smaller than 0.175° (1.4*1.8), which requires harmonic gear or other mechanical structure with higher accuracy.

To solve above mentioned problems, a conventional satellite antenna disclosed in Chinese patent CN 101950844 B is shown in FIG. 1, an antenna reflector 104 is mounted on a foldable fulcrum bar 103, and various regulation of the antenna reflector 104 is completed by all of an orientation regulator 102, a horizontal regulator 105, and a pitch regulator 107 to meet the high precision requirements for the transmission mechanism. A bottom of the antenna is secured by an antenna base 101, a foldable feed source module 111 is mounted on a feed source fulcrum bar 108. This antenna is configured as a structure of "reflector-regulator-supporter", i.e. "large-small-large" structural mode, which is not steady enough.

Alternatively, FIG. 2 shows another conventional satellite antenna, such as potable satellite antenna AKD3000D12 made by AKD COMMUNICATION TECHNOLOGY CO., LTD, which shows the connection between an antenna reflector 204, an orientation regulator 203, an antenna base 201, a supporting leg 202, and a feed source module 205, all of those also constitute a "large-small-large" structural mode. This structure is different from that in FIG. 1 as the feed source module 205 is mounted on the antenna base 201, which increases the overall stability but inevitably increases the overall weight causing inconvenience to carry.

SUMMARY OF INVENTION

An aspect relates to a rail-type portable satellite communication antenna with communication module that ensures high precision of mechanical transmission for tracking signals, and the antenna also features light weight, compact size, easy to carry and manufacture.

For the above purposes, the technical solution is as follows.

A rail-type portable satellite communication antenna, comprising an antenna communication module, a supporting module, a rail base, and a driving module for driving the supporting module to rotate horizontally and to regulate its pitch angle; the rail base, the supporting module and driving module are located at bottom of the antenna communication module, and the driving module is located on the end surface of the supporting module, and the supporting module is connected slidably to the rail base.

Further, the supporting module comprises a horizontal rotary bracket, a pitch supporter, and a pitch driving mechanism; the pitch supporter, at its top end, is connected to a bottom of the antenna communication module angularly and the bottom end of the pitch supporter is connected to a connection point in the horizontal rotary bracket; the horizontal rotary bracket is shaped as polygon, the driving modules are connected in the polygon at each corner; a first limit wheel is configured at each connection point of the horizontal rotary bracket, and is also engaged with the rail base; the top end of the pitch driving mechanism is connected to the bottom of the antenna communication module and the bottom end of the pitch driving mechanism is connected to the horizontal rotary bracket.

Further, several grooves or holes are equally spaced on the rail base, to engage with the driving module.

Further, teeth are configured on the surface of the rail base, to engage with the driving module.

Further, the rail base is ring-shaped.

Further, the rail base is a rollable ring, or a segments-composable ring or a rollably-segments-composable ring.

Further, the driving module comprises a driving motor, a bearing wheel, and a driving gear; the driving motor and the driving gear are connected in a transmission manner; the bearing wheel is configured on the top of the rail base to bear the weight of the communication module; the driving gear is located on one side of the rail base, and is engaged with the grooves, holes or teeth; the first limit wheel is located on the other side of the rail base in order to limit the movement of the driving gear along the grooves, holes or teeth on the rail base.

Further, the driving module comprises a bearing wheel, a second limit wheel, a locking element and human machine interaction interface; the bearing wheel is configured on the top of the rail base to bear the weight of the communication module; the first limit wheel is arranged on one side of the rail base; the second limit wheel is located on the other side of the rail base in order to limit the movement of the driving module along the rail base; the locking element is located at the same side where the second limit wheel is located; the human machine interaction interface is located at the same side where the antenna communication module or the supporting module is located.

Further, the antenna communication module comprises a feed source device, a feed source bar, an antenna reflector and an equipment box; the equipment box is mounted on the bottom of the antenna reflector or on the horizontal rotary bracket; the feed source device is mounted on one side of the antenna reflector by the feed source bar; the supporting module further comprises a feed source supporter, whose top end supports the feed source bar and whose bottom end extends through the antenna reflector and connects the back side of the antenna reflector.

Further, the antenna communication module is a planar waveguide horn array antenna.

Comparing to the prior art, the advantage of the present disclosure is as follows:

The rail-type portable satellite communication antenna according to the present disclosure makes both the current regulating device and supporting device in one, that is, the "large-small-large" structural mode is abandoned, and the rail base and the supporting device are used to complete the adjusting and supporting function. Meanwhile the driving assembly are used to provide driving force during the adjustment to complete the horizontal rotation and the pitch tilt adjustment of the antenna.

Through the above designed structure, the supporting part used in the prior art disappear, so that the overall weight is greatly reduced, and at the same time, the entire device can be split and folded, so that the space occupied when stowed is small. In addition, for the precision requirements in the transmission process, the precision can be less than 0.2°.

BRIEF DESCRIPTION OF DRAWINGS

Some of the embodiments will be described in detail, with references to the following figures, wherein like designations denote like members, wherein:

FIG. 5 (*b*) depicts a structural view of segments of disassembled rail base of the rail-type potable satellite antenna according to the Embodiment 1;

FIG. 5(*c*) depicts a structural view of a rail base of the rail-type potable satellite antenna when the rail base was disassembled and stowed, according to the Embodiment 1;

FIG. 6(*b*) depicts an enlarged view of A section in FIG. 3;

FIG. 6(*c*) depicts an enlarged view of A section in FIG. 3;

Figure 1:
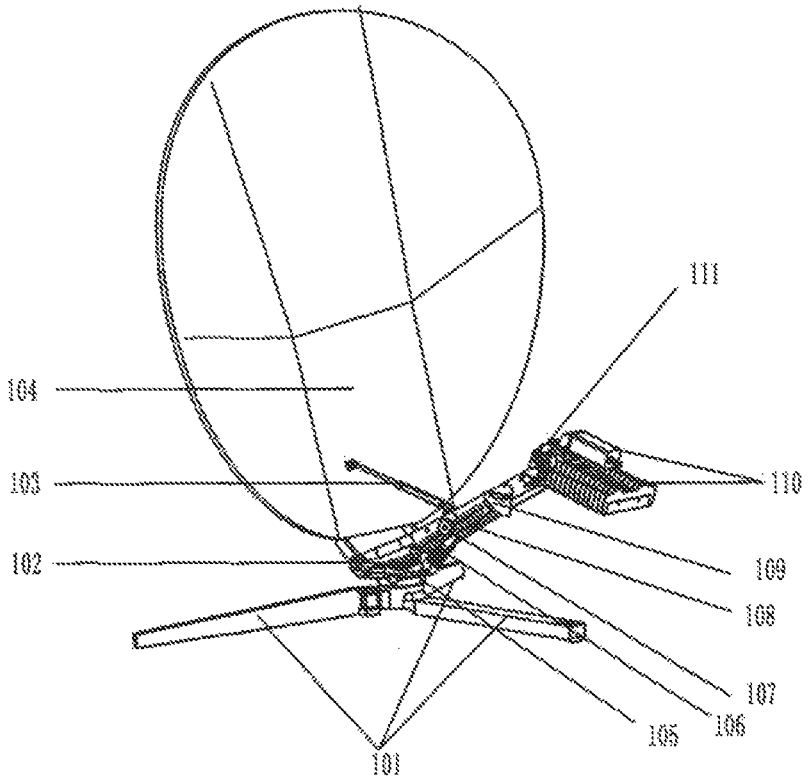
Figure 1 (PRIOR ART)
FIG. 1 depicts a structural view of a conventional satellite antenna in the background.
Figure 2:
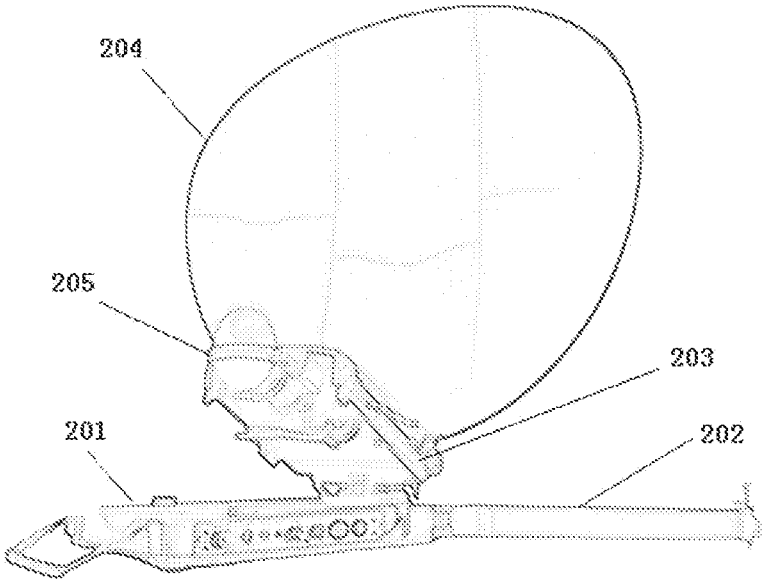
Figure 2 (PRIOR ART)
FIG. 2 depicts a structural view of another conventional satellite antenna in the background.
Figure 3:
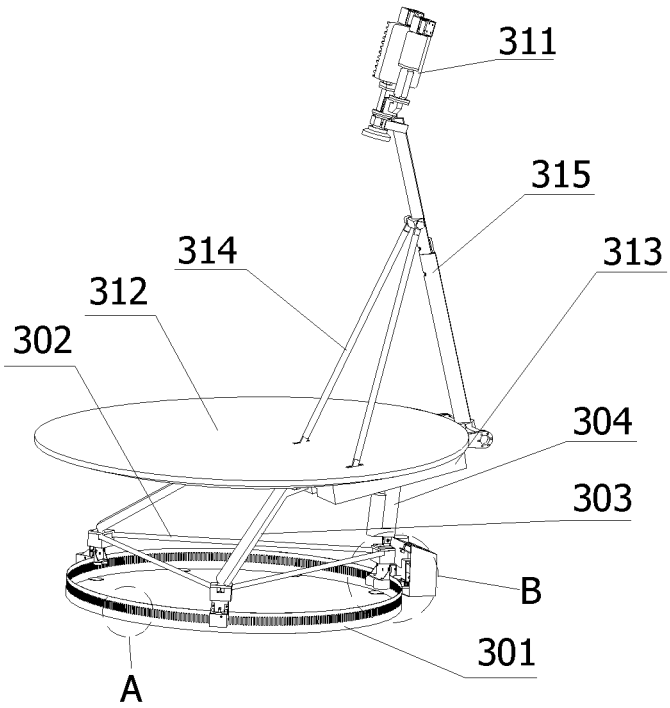
FIG. 3 depicts a structural view of a rail-type potable satellite antenna according to the Embodiment 1.
Figure 4:
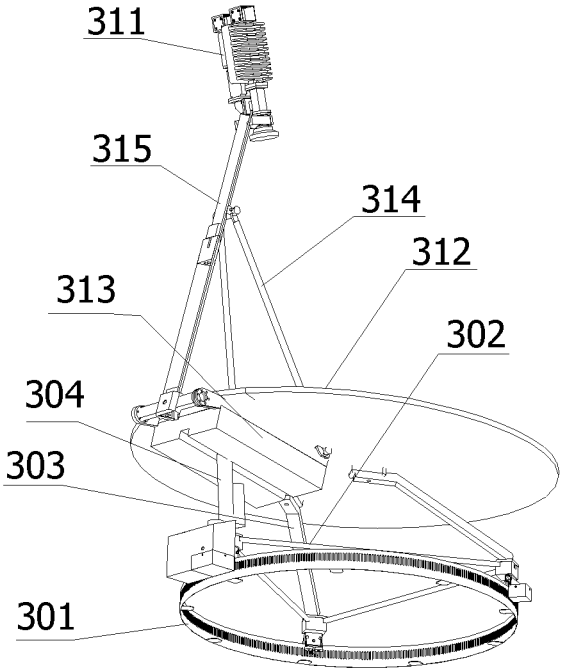
FIG. 4 depicts a bottom, structural view of a rail-type potable satellite antenna according to the Embodiment 1.

In the figures and in the detailed part of the description, the following reference numerals have been used:

101 antenna base
102 orientation regulator
103 antenna reflector foldable fulcrum bar
104 antenna reflector
105 horizontal regulator
106 pitch supporter
107 pitch regulator
108 feed source fulcrum bar
109 pitch angle indication
110 radio frequency unit
111 foldable feed source module
201 antenna base
202 supporting leg
203 orientation regulator
204 antenna reflector
205 feed source module
301 rail base
302 horizontal rotary bracket
303 pitch supporter
304 pitch driving mechanism
305 first limit wheel
306(*a*) groove
306(*b*) hole
306(*c*) teeth
307 driving motor
308 bearing wheel
309 driving gear
310 second limit wheel
311 feed source device
312 antenna reflector
313 equipment box
314 feed source supporter
315 feed source bar
316 locking element
318 antenna communication module as planar waveguide horn array antenna

DETAILED DESCRIPTION

Preferred embodiments of the present disclosure will be described hereinafter with reference to the figures. It should be understood that the preferred embodiments is merely explanation and interpretation of the present disclosure, and is not intended to limit the protection scope of the present disclosure.

The rail-type portable satellite communication antenna according to the present disclosure employs a rail base, which not only acts as a bracket but also cooperates with the driving module to complete operations of horizontal rotation, thereby making both the regulator and supporter in the prior art in one while regulating horizontal rotation and pitch angle in high precise. This causes a smaller size of the antenna after disassembled, and its lighter weight.

In order to understand the structure of the rail-type portable satellite communication antenna according to the present disclosure, the following will be specifically described with reference to FIG. 1 to FIG. 13.

Embodiment 1

As shown in FIGS. 1-7, the rail-type portable satellite communication antenna according to the present disclosure comprises an antenna communication module, a rail base 301, a support module and a driving module. The driving module can drive the support module to rotate horizontally and/or regulate its pitch angle. The driving module and the support module are both located at bottom of the antenna communication module, and the driving module is located on end surface of the support module, and the support module is connected slidably to a rail base 301.

Figure 5A:
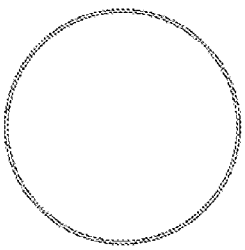
FIG. 5 (*a*) depicts a structural view of a rail base of a rail-type potable satellite antenna according to the Embodiment 1.
Figure 5B:
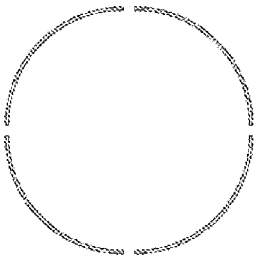
Figure 5C:
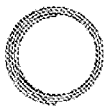

The support module comprises a horizontal rotary bracket 302, a pitch supporter 303 and a pitch driving mechanism 304. The rail base 301 is ring-shaped, which can be in the states in FIGS. 5(*a*), 5(*b*) and 5(*c*). In FIG. 5(*a*), the rail base 301 is either a continuous ring or a ring with a breakpoint; In FIG. 5(*b*), the rail base 301 is detached into multiple segments; In FIG. 5(*c*), the multiple segments are rolled up respectively and gather into one roll, which is easy to carry.

Figure 6A:
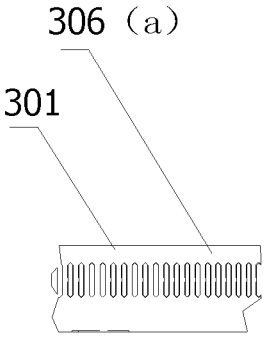
FIG. 6(*a*) depicts an enlarged view of A section in FIG. 3.
Figure 6B:
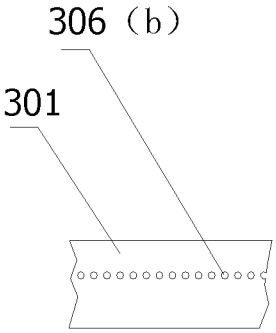
Figure 6C:
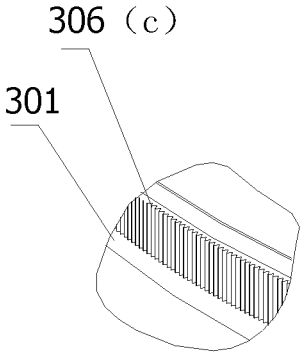
Figure 7:
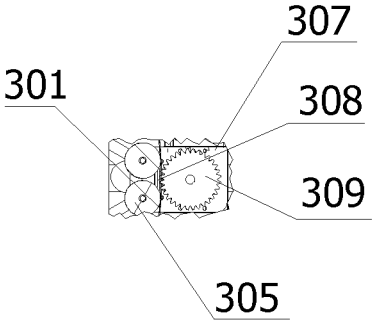
FIG. 7 depicts an enlarged view of B section in FIG. 3.

As shown in FIG. 6(*a*), several grooves 306(*a*) are equally spaced on the rail base 301 to ensure a precisely horizontal movement of the support module, as a first limit wheel 305 can move along the grooves 306(*a*). Alternatively, the grooves 306(*a*) can be holes 306(*b*) as specifically shown in FIG. 6(*b*). It should be noted that, the grooves 306(*a*) or holes 306(*b*) or any structures having the same function would be within the protection scope of the present disclosure.

Moreover, teeth 306(*c*) are configured on the surface of the rail base 301, to engage with the support module for its precisely horizontal rotation. Similarly, any gear transmission mechanisms having the same function of the teeth 306 would be within the protection scope of the present disclosure. Similarly, any other structures which accomplish a horizontal slide, such as friction driving structure, belt transmission or screw driving structure, are also within the protection scope of the present disclosure.

The top end of the pitch supporter 303 is connected to the bottom of the antenna communication module and the bottom end of the pitch supporter 303 is connected to a connection point in the horizontal rotary bracket 302. The pitch supporter 303 is at an angle to the horizontal rotary bracket 302 for better support to the antenna communication module.

The horizontal rotary bracket 302 is shaped as polygon and is shown as a triangle in the figures, providing stability, the driving modules are connected in the polygon at each corner. The horizontal rotary brackets 302 is not limited to triangle as shown in the figures, it can be adjusted according to actual requirement. A first limit wheel 305 clamping at the rail base 301 is provided at each connection point of the horizontal rotary brackets 302. The top end of the pitch driving mechanism 304 is connected to the bottom of the antenna communication module and the bottom end of the pitch driving mechanism 304 is connected to the horizontal rotary bracket 302.

The driving module comprises a driving motor 307, a bearing wheel 308, and a driving gear 309; the driving motor 307 and the driving gear 309 are connected in a transmission manner; the bearing wheel 308 is configured on the top of the rail base 301 to bear the weight of the communication module; the driving gear 309 is configured at one side of the rail base 301, to engage with the grooves 306(*a*) and the first limit wheel 305 is located at the other side of the rail base 301, to limit the movement of the driving gear 309 along the grooves 306(*a*).

The antenna communication module comprises a feed source device 311, a feed source bar 315, an antenna reflector 312 and an equipment box 313; the equipment box 313 is mounted on a bottom of the antenna reflector 312 or on the horizontal rotary bracket 302, and the feed source device 311 is mounted on one side of the antenna reflector 312 via the feed source bar 315. The support module also comprises a feed source supporter 314, whose top end supports the feed source bar 315 and whose bottom end extends through the antenna reflector 312 and connects the back side of the antenna reflector 312.

The equipment box 313 is located at the bottom of the antenna reflector 312 or on the horizontal rotary bracket 302 but is not limited to these two positions. It is possible to arrange the equipment box 313 at any suitable positions that does not affect the normal operation of the entire device, and such suitable positions also fall within the scope of protection of the present disclosure.

Figure 8:
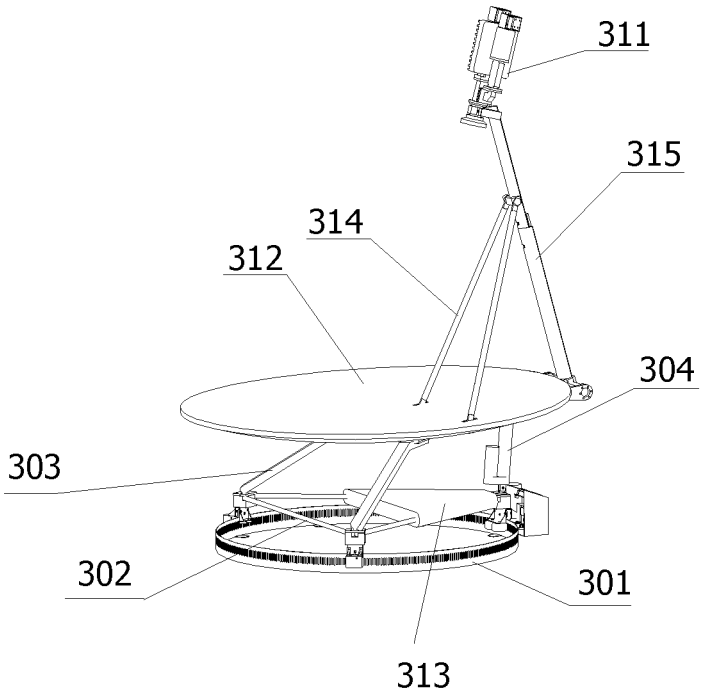
FIG. 8 depicts a rail-type potable satellite antenna according to the Embodiment 1, where an equipment box mounted on a horizontal rotary bracket.

As shown in FIG. 8, the equipment box 313 is located on the horizontal rotary bracket 302. This arrangement makes the entire antenna more steady than the Embodiment 1, 2, or 3 due to its center of gravity going down. Moreover, the equipment box 313 can cover the entire horizontal rotary bracket 302 and function as the horizontal rotary bracket 302, this manner also falls within the scope of protection of the present disclosure.

Embodiment 2

Figure 9:
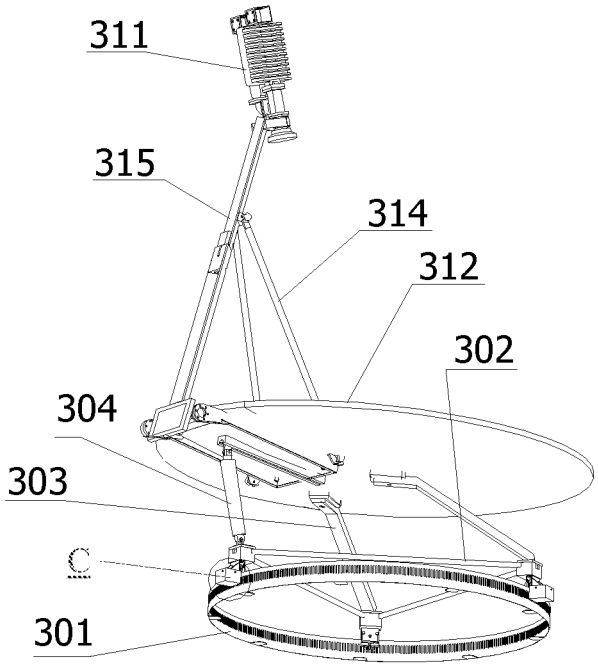
FIG. 9 depicts a structural view of a rail-type potable satellite antenna according to the Embodiment 2.

Referring to FIG. 9, the Embodiment 2 employs manual regulating mode, i.e. having the driving module being modified and human machine interaction interface, which differs from the Embodiment 1. The driving module comprises a bearing wheel 308, a second limit wheel 310, a locking element 316 and human machine interaction interface. The bearing wheel 308 is configured on the top of the rail base 301 to bear the weight of the communication module; the second limit wheel 310 is arranged on one side of the rail base 301 and the first limit wheel 305 is located on the other side of the rail base 30, to limit the movement of the driving module along the rail base 301; the locking element 316 is located at the same side with the second limit wheel 310 for locking the second limit wheel 310 after the antenna is aligned to the target satellite, thereby the second limit wheel 310 will not move under external forces and the accuracy of signal received is ensure. The human machine interaction interface is located at the same side with the antenna communication module or the supporting module, and the users can observe thereon whether the antenna is aligned to the target satellite to anticipate the timing to lock the horizontal structure.

Figure 10:
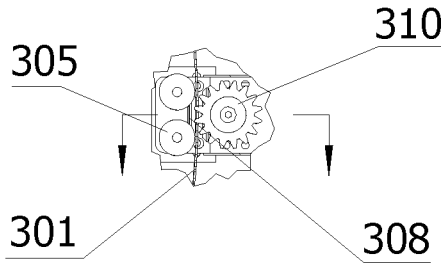
FIG. 10 depicts an enlarged, bottom view of C section in FIG. 9.
Figure 11:
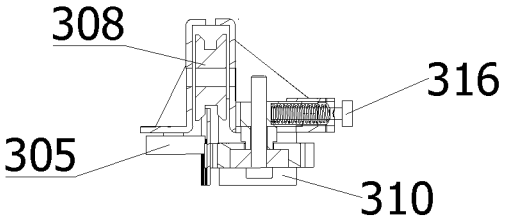
FIG. 11 depicts a cross-section view of FIG. 10, in the direction of the arrow.

It should be noted that, the second limit wheel 310 is shown in the form of gear, as shown in FIG. 10, but the second limit wheel 310 is not limited to a gear, any suitable shape element having same function, such as wheel structures with a thread or a certain coefficient of friction on its outer wall, is possible.

The entire weight in this embodiment is further reduced for omitting the driving motor, and the portability is enhanced.

Embodiment 3

Figure 12:
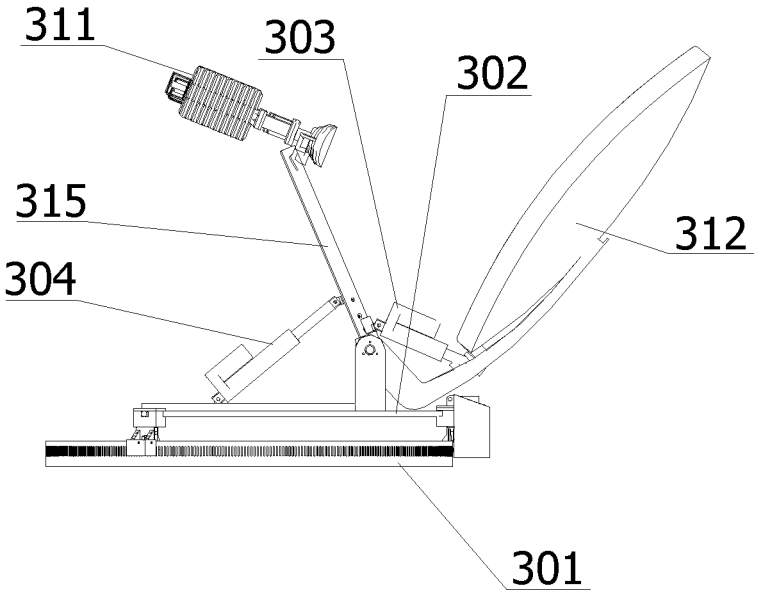
FIG. 12 depicts a rail-type potable satellite antenna according to the Embodiment 3.

Referring to FIG. 12, this embodiment employs the antenna reflector 312 which was installed in forward direction, which differs from the Embodiment 1 & 2 where the antenna reflector 312 was installed in backward direction. The difference therebetween can be observed in FIGS. 3-4 of the embodiment 1, and FIG. 12 of this embodiment.

It is two different ways to utilize the antenna for the antenna reflector 312 being installed in forward direction or backward direction. Both ways have the same antenna gain and capacity to receive signals, but have differences that, antenna reflector 312 being installed in forward direction is used in an environment with a broad view ahead, while antenna reflector 312 being installed in backward direction is used in an environment with a broad view above, preventing from gathering dust or snow thereon, and has better wind-resistant and saves space.

Embodiment 4

Figure 13:
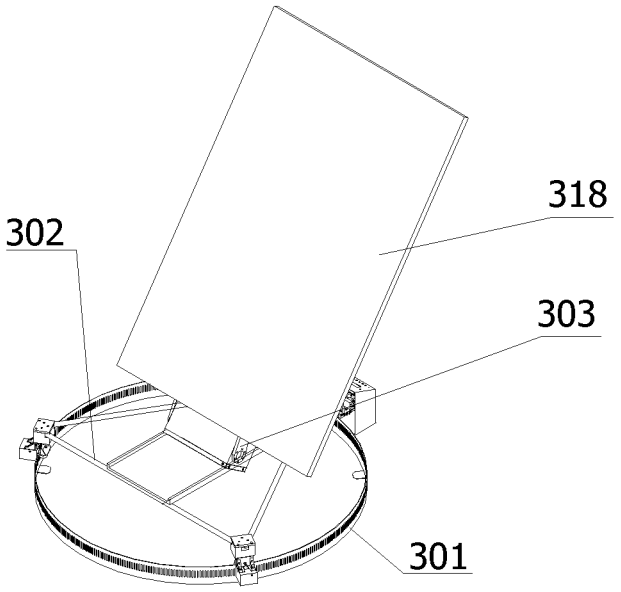
FIG. 13 depicts a rail-type potable satellite antenna according to the Embodiment 4.

This embodiment is different from the embodiment 1-3, in that planar waveguide horn array antenna is used in the antenna communication module, which is specifically shown in FIG. 13.

Therefore, the installing direction can vary according requirement in actual application, which broaden the usable range.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed is:

1. A rail-type portable satellite communication antenna, comprising an antenna communication module, a supporting module, a rail base, and a driving module for driving the supporting module to rotate horizontally and to regulate its pitch angle; wherein the rail base, the supporting module and driving module are located at bottom of the antenna communication module, and the driving module is located on the end surface of the supporting module, and the supporting module is connected slidably to the rail base; and the supporting module is seated on the rail base, through multiple points.

2. The rail-type portable satellite communication antenna of claim 1, wherein the supporting module comprises a horizontal rotary bracket, a pitch supporter, and a pitch driving mechanism;

the pitch supporter, at its top end, is connected to a bottom of the antenna communication module angularly and the bottom end of the pitch supporter is connected to a connection point in the horizontal rotary bracket;

the horizontal rotary bracket is shaped as polygon, the driving modules are connected in the polygon at each corner;

a first limit wheel is configured at each connection point of the horizontal rotary bracket, and is also engaged with the rail base; and the top end of the pitch driving mechanism is connected to the bottom of the antenna communication module and the bottom end of the pitch driving mechanism is connected to the horizontal rotary bracket.

3. The rail-type portable satellite communication antenna of claim 2, wherein several grooves or holes are equally spaced on the rail base, to engage with the driving module.

4. The rail-type portable satellite communication antenna of claim 2, wherein teeth are configured on the surface of the rail base, to engage with the driving module.

5. The rail-type portable satellite communication antenna of claim 3, wherein the rail base is ring-shaped.

6. The rail-type portable satellite communication antenna of claim 4, wherein the rail base is ring-shaped.

7. The rail-type portable satellite communication antenna of claim 3, wherein the rail base is a rollable ring, or a segments-composable ring or a rollably-segments-composable ring.

8. The rail-type portable satellite communication antenna of claim 4, wherein the rail base is a rollable ring, or a segments-composable ring or a rollably-segments-composable ring.

9. The rail-type portable satellite communication antenna of claim 3, wherein the driving module comprises a driving motor, a bearing wheel, and a driving gear;

the driving motor and the driving gear are connected in a transmission manner;

the bearing wheel is configured on the top of the rail base to bear the weight of the communication module;

the driving gear is located on one side of the rail base, and is engaged with the grooves, holes or teeth; and the first limit wheel is located on the other side of the rail base in order to limit the movement of the driving gear along the grooves, holes or teeth on the rail base.

10. The rail-type portable satellite communication antenna of claim 4, wherein the driving module comprises a driving motor, a bearing wheel, and a driving gear;

the driving motor and the driving gear are connected in a transmission manner;

the bearing wheel is configured on the top of the rail base to bear the weight of the communication module;

the driving gear is located on one side of the rail base, and is engaged with the grooves, holes or teeth; and the first limit wheel is located on the other side of the rail base in order to limit the movement of the driving gear along the grooves, holes or teeth on the rail base.

11. The rail-type portable satellite communication antenna of claim 3, wherein the driving module comprises a bearing wheel, a second limit wheel, a locking element and human machine interaction interface;

the bearing wheel is configured on the top of the rail base to bear the weight of the communication module;

the first limit wheel is arranged on one side of the rail base;

the second limit wheel is located on the other side of the rail base in order to limit the movement of the driving module along the rail base;

the locking element is located at the same side where the second limit wheel is located; and the human machine interaction interface is located at the same side where the antenna communication module or the supporting module is located.

12. The rail-type portable satellite communication antenna of claim 4, wherein the driving module comprises a bearing wheel, a second limit wheel, a locking element and human machine interaction interface;

the bearing wheel is configured on the top of the rail base to bear the weight of the communication module;

the first limit wheel is arranged on one side of the rail base;

the second limit wheel is located on the other side of the rail base in order to limit the movement of the driving module along the rail base;

the locking element is located at the same side where the second limit wheel is located; and the human machine interaction interface is located at the same side where the antenna communication module or the supporting module is located.

13. The rail-type portable satellite communication antenna of claim 2, wherein the antenna communication module comprises a feed source device, a feed source bar, an antenna reflector and an equipment box;

the equipment box is mounted on the bottom of the antenna reflector or on the horizontal rotary bracket;

the feed source device is mounted on one side of the antenna reflector by the feed source bar; and the supporting module further comprises a feed source supporter, whose top end supports the feed source bar and whose bottom end extends through the antenna reflector and connects the back side of the antenna reflector.

14. The rail-type portable satellite communication antenna of claim 1, wherein the antenna communication module is a planar waveguide horn array antenna.

* * * * *